United States Patent [19]

Smith

[11] Patent Number: 4,779,608

[45] Date of Patent: Oct. 25, 1988

[54] FIREPLACE STARTER APPARATUS

[76] Inventor: T. Randolph Smith, 400 N. St. Paul, 705 The Hartford Building, Dallas, Tex. 75201

[21] Appl. No.: 148,141

[22] Filed: Jan. 25, 1988

Related U.S. Application Data

[62] Division of Ser. No. 931,648, Nov. 17, 1986, abandoned.

[51] Int. Cl.[4] ..... F24C 3/00; F24B 3/00

[52] U.S. Cl. ..... 126/127; 126/25 B; 431/344; 431/345

[58] Field of Search ..... 431/343, 345, 344; 126/25 B, 152 B, 152 R, 120, 127

[56] References Cited

U.S. PATENT DOCUMENTS

| | | | |
|---|---|---|---|
| 65,448 | 6/1867 | Tansey . | |
| 67,382 | 7/1867 | Van Ausdall . | |
| 420,056 | 1/1890 | Hackney . | |
| 510,447 | 12/1893 | Smith . | |
| 1,012,355 | 12/1911 | Herder . | |
| 1,218,284 | 3/1917 | Lekberg | 431/345 X |
| 1,353,214 | 9/1920 | Calmer . | |
| 1,753,390 | 4/1930 | Taschner . | |
| 3,033,275 | 5/1962 | Nichols | 158/10 |
| 3,042,109 | 7/1962 | Peterson | 126/127 |
| 3,143,107 | 8/1964 | Lindgren | 126/271.2 |
| 3,385,651 | 5/1968 | Rasmussen et al. | 126/127 X |
| 3,589,312 | 6/1971 | Cooper | 126/25 B |
| 3,605,653 | 9/1971 | Donnel | 110/1 F |
| 3,674,413 | 7/1972 | Fraser | 431/344 |
| 4,013,398 | 3/1977 | Hendrix | 431/344 |
| 4,222,734 | 9/1980 | Nolf | 431/156 |
| 4,253,820 | 3/1981 | Jarreau | 431/344 |
| 4,422,435 | 12/1983 | Spell | 126/25 B |
| 4,522,585 | 6/1985 | Martin | 431/344 |
| 4,545,759 | 10/1985 | Giles et al. | 431/344 |

FOREIGN PATENT DOCUMENTS

| | | | |
|---|---|---|---|
| 2044442 | 10/1980 | United Kingdom | 126/127 |

*Primary Examiner*—Randall L. Green
*Attorney, Agent, or Firm*—Crutsinger & Booth

[57] ABSTRACT

Disclosed is apparatus for igniting combustible material fin a fireplace or the like. The apparatus includes a portable, self contained pressurized canister of a fuel such as propane or butane. A burner is secured to a grate or the like in the fireplace. A conduit extends from the canister to the burner for conveying the fuel and releasing the fuel through apertures in the burner adjacent the combustible material. The fuel is then ignited externally of the burner. The conduit is connected to the burner by a connector that is easily engaged or disengaged so that during periods of nonuse, the burner remains secured to the grate and the canister and conduit may be remotely stored. Preferably, the apparatus includes means for regulating the flow of the fuel and the mixture of the fuel with air prior to release of the air/fuel mixture from the burner.

11 Claims, 3 Drawing Sheets

FIREPLACE STARTER APPARATUS

This is a divisional of application Ser. No. 931,648, filed Nov. 17, 1986, abandoned.

FIELD OF THE INVENTION

This invention relates generally to fireplaces and the like and more particularly to apparatus for starting a fire in a fireplace.

BACKGROUND OF THE INVENTION

Manually starting a fire in a fireplace is a tedious and time consuming task. Apparatus have been devised in the past to overcome the difficulties inherent in manually starting a fire in a fireplace. It is known to mount a starter element or burner in the fireplace and to connect the starter element to a supply of natural gas. The natural gas is released by the starter element adjacent the wood or other combustible material in the fireplace and externally ignited. The combustion of the natural gas facilitates the ignition of the combustible material in the fireplace and may be discontinued after the fire is self sustaining.

However, such conventional fireplace starter apparatus suffers from several inefficiencies. Foremost is the lack of a source of natural gas in many buildings. It is difficult, expensive and in some cases, impossible to retroactively install a natural gas pipeline system in an existing building. Occasionally, fireplaces are added to an existing building with a natural gas pipeline system, which still encounters all of the limitations discussed above in connecting the fireplace to the natural gas pipeline system.

To overcome this problem, systems have been devised in the past that are portable and self contained, such as is shown in U.S. Pat. No. 4,522,585, issued to Martin. Such portable systems use a canister of a pressurized fuel such as butane or propane located exteriorly of the fireplace. The fuel is conveyed into the fireplace and is released by a starter element or burner placed on the bottom of the fireplace beneath the wood or other combustible material. The fuel is then ignited as in permanently installed systems.

Although such portable systems are desirable for use in fireplaces that are not otherwise connected to a source of natural gas or the like, they still exhibit certain undesirable characteristics. It is sometimes desirable to remove the apparatus from the fireplace during periods of nonuse, for cosmetic or safety reasons. This requires that the starter element be removed from the bottom of the fireplace, carrying with it ashes, soot and other undesirable contaminants. Frequent cleaning of the starter element is messy and time consuming. External storage of the entire starter apparatus, which is relatively bulky and space consuming, is bothersome and inconvenient and creates unnecessary delays in reinstalling the entire system each time a fire is desired. In addition, the starter element will be heated during use to a temperature that is uncomfortable to handle during or just after use. Thus, the apparatus must remain in the fireplace for an extended period of time after use to allow it to cool. Also, storage of the burner at elevated temperatures next to combustible materials externally of the fireplace (i.e. newspapers, carpeting, rugs, wood or the like) is extremely hazardous. Existing fireplace starter apparatus such as the starter apparatus in the Martin patent places the starter element well below the wood or other combustible material in the fireplace and does not secure the element in a predefined fixed location during use in relation to the wood, and therefore limits the efficiency of the starter apparatus.

SUMMARY OF THE INVENTION

The fireplace starter apparatus of this invention provides a canister of a pressurized fuel conveyed by a flexible conduit to a starter element or burner within a fireplace. A valve controls the flow of the fuel from the canister. The starter element is preferably secured in a predetermined fixed position to a grate or the like supporting a combustible material such as wood. The conduit and the starter element each include cooperative connector portions that are easily and quickly connected and disconnected. Means are provided to ignite the fuel exteriorly of the starter element.

Therefore, it is a principal feature and advantage of this invention to provide an improved fireplace starter apparatus.

It is another feature and advantage of this invention to provide an improved fireplace starter apparatus in which the fuel source is easily and quickly connected and disconnected from the starter element in the fireplace.

It is yet another feature and advantage of this invention to provide an improved fireplace starter apparatus in which the starter apparatus is secured in a fixed predetermined position within the fireplace.

It is another feature and advantage of this invention to provide an improved fireplace starter apparatus that is safe during use and while stored.

BRIEF DESCRIPTION OF THE DRAWINGS

So that the manner in which the features and advantages of the invention recited herein, as well as others which will become apparent to those skilled in the art, are obtained and can be understood in detail, a more particular description of the invention briefly summarized above may be had by reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

DETAILED DESCRIPTION OF THE INVENTION

Figure 1:
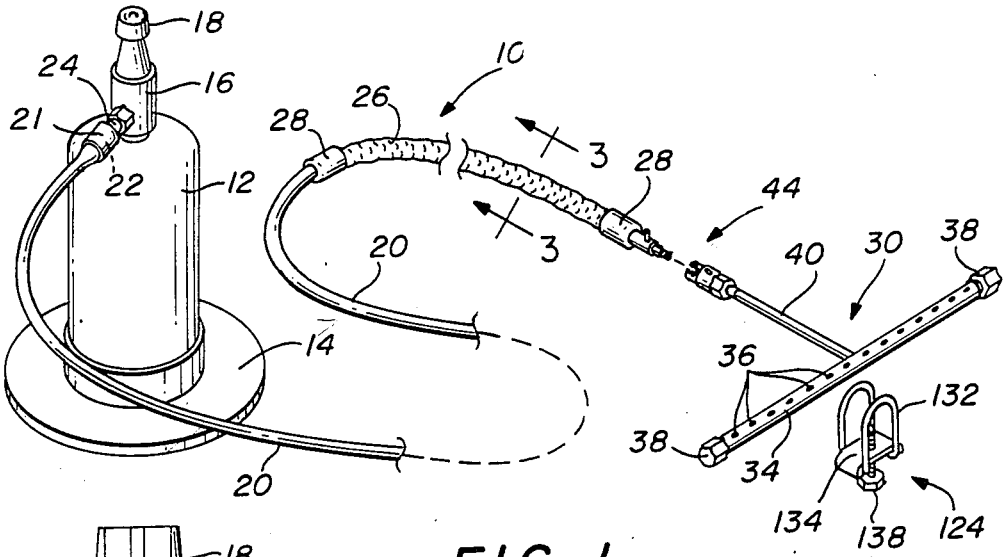
FIG. 1 is a front view of the fireplace starter apparatus of this invention.

Referring now to FIG. 1 there is shown the fireplace starter apparatus 10 of this invention and including canister 12 containing pressurized fluid fuel. Suitable pressurized canisters of fuels including, but not limited to, fuels such as propane or butane are readily available such as for propane torches, gas fueled lanterns or stoves. For instance, such canisters are marketed by Coleman Industries or under the brand name "Wagon Master" by Turner Corporation. The canister is received in a circular holder 14 supporting the canister in a generally upright position.

The upper end of the canister includes valve 16 for controlling the flow of the pressurized fuel from the canister. The valve 16 is manually actuated by handle 18 between open and closed positions. The valve also includes means (not shown) to regulate the pressure of the fuel downstream of the canister to any desired level. Typically, canisters of fuel are available pressurized at 100–150 p.s.i. at room temperature. Means such as a regulator provided as part of the valve may reduce the pressure of the fuel downstream of the valve to approximately 15 p.s.i. Of course a valve may be employed without regulator means, if desired, so that the fuel is ejected from the canister when the valve is in an open position, and contained with the canister when the valve is in closed position. The flow rate of the fuel may also be controlled by adjusting the valve to a point intermediate the fully open and fully closed positions.

Conduit 20 is provided to convey the fuel from the canister. One end 22 of conduit 20 is secured such as by clamp 21 to standard fitting 24 on the valve 16 of the canister, as is shown in detail in FIG. 2. Of course numerous other arrangements are possible for securing the conduit to the valve of the canister in fluid tight relationship, as is known in the art. The conduit 20 must be capable of withstanding the pressure exerted by the fuel flowing through the conduit and must also be abrasion and puncture resistant to prevent accidental release of the fuel from the apparatus, with obvious adverse safety affects. Further, the material of the conduit must be resistant to elevated temperatures encountered while in use near or in a fireplace (not shown). As further protection, protective sleeve 26 may be placed at least about the end of the conduit to be inserted into the fireplace, as shown in cross section in FIG. 3. The sleeve 26 is constructed of a material designed for prolonged and repeated exposure to temperatures commonly encountered in and near fireplaces. For instance, the Aeroquip model AE102/624 firesleeve or the Fyrejacket brand silicone coated fiberglass sleeving offered by Bently Harris have been found to be suitable for applications in a fireplace about conduit 20. The ends of the sleeve are secured in place adhesively or by a pair of clamps 28 or any other suitable device. Alternatively, the sleeve may be omitted if desired.

The other end of the conduit 20 extends to starter element or burner 30. The burner includes a longitudinal hollow tubular section 34 having a plurality of spaced apertures 36 along its length. The apertures may take the form of holes as shown or alternatively, may be formed by cutting slots into the tubular section 34, as well as by other arrangements as are found to be advantageous. Both ends of the tubular section 34 are sealed, such as by plugs 38 or by crimping. Preferably at least one of the plugs is removable for cleaning of the interior of the burner which might periodically tend to accumulate ashes or other impediments to the flow of fuel through the burner. A transverse hollow tubular section 40 is connected to the tubular section 34 generally at its midpoint. Of course, other burner configurations are possible. For instance, a single length of tubing may be used, positioned transversely with respect to the grate. The conduit could be connected to one end of the burner with the other end of the burner being sealed.

Figure 5:
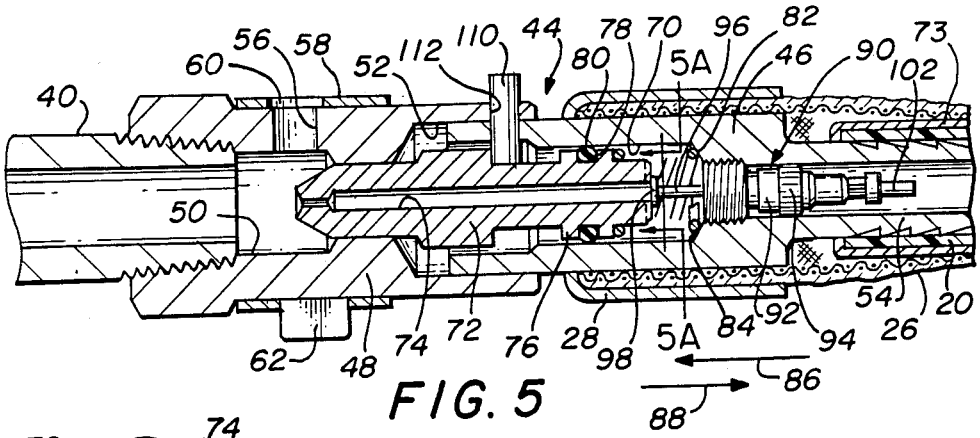
FIG. 5 is a cross sectional view of the connector of FIG. 4 along plane 5—5.
Figure 6:
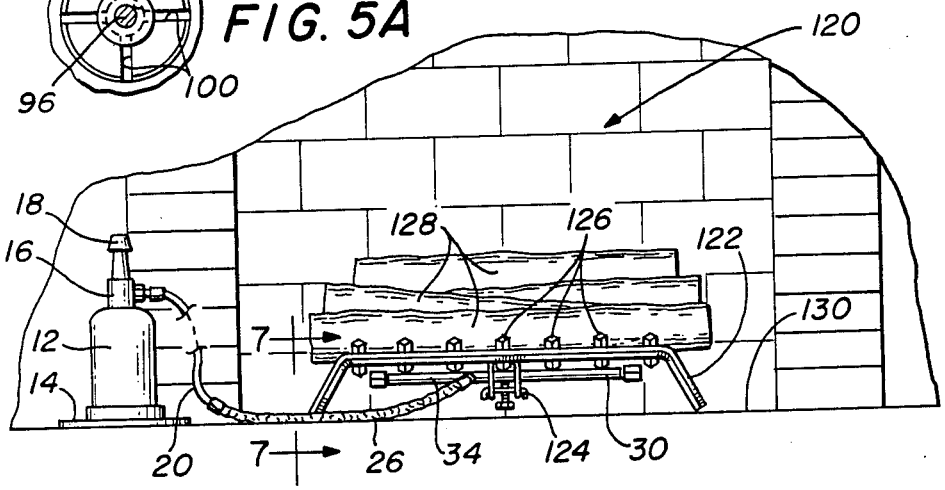
FIG. 6 is a front plan view of the fireplace starter apparatus of FIG. 1 installed in a fireplace.

Connector 44, shown in more detail in FIGS. 5 and 6, is provided to enable the conduit 20 and the burner 30 to be quickly and easily connected for conveying fuel from the canister into the fireplace. The connector 44 includes male connector portion 46 mounted on the end of the conduit and cooperative female connector portion 48 mounted on the end of the transverse tubular section 40 of the burner. Of course, the relative positions of the male and female portions of the connector could be reversed if desired, without affecting the operation of the apparatus as hereinafter described. The female connector portion 48 defines a longitudinal passageway 50 terminating in an enlarged cavity 52 at one end. The other end of the female connector portion is connected to the tubular section 40 such as by the threaded connection shown. The female connector may also include radial air hole 56 communicating between the longitudinal passageway 50 and exteriorly of the connector, enabling air to enter the passageway. Slip ring 58 may be mounted on the exterior of the female connector portion body. The slip ring 58 includes hole 60 longitudinally aligned with the exterior end of the air hole 56 so that rotation of the slip ring relative to the female connector will bring the hole 60 into and out of alignment with the air hole 56. By adjusting the relative positions of the hole 60 of the slip ring 58 and the air hole 56, the amount of air entering the passageway 50 of the female connector portion and intermixing with the fuel, relative to the flow rate of the fuel through the connector, may be determined and controlled. Handle 62 is formed in the slip ring by deflecting a rectangular section of the slip ring radially outward to enable the slip ring to be easily rotated on the female connector portion. Alternatively, the handle or the entire slip ring may be omitted or a regulating screw (not shown) substituted for the slip ring. The regulating screw could be threadedly engaged with air hole 56 and screwing the regulating screw into and out of the hole 56 would act to regulate the inflow of air to passageway 50.

Figure 2:
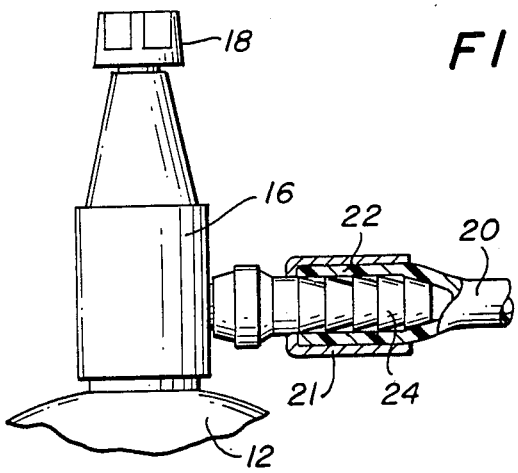
FIG. 2 is a magnified detailed view, partially in cross section, of the connection of the conduit to the valve on the canister of fuel in FIG. 1.
Figure 3:
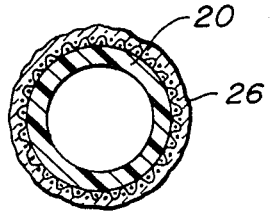
FIG. 3 is a cross-sectional view, taken along plane 3—3, of the conduit of FIG. 1.

The male connector portion 46 defines a longitudinal passageway 70 and having one end connected to conduit 20 such as by clamp 73 to fitting 71 similar to that shown in FIG. 2. Piston 72 is slidingly constrained within the passageway 70 of the male connector portion 48 and likewise defines a longitudinal passageway 74. The piston includes annular flange 76 defining annular groove 78 receiving O-ring 80 for sealing against the walls of the passageway 70 during reciprocal motion of the piston therewithin. Spring 82 is located with one end in contact with shoulder 84 formed in the passageway 70 and the other end in contact with the annular flange 76 on the piston so as to resiliently urge the piston outwardly of the passageway 70 in direction 86.

Means are provided to automatically seal the male connector portion when not engaged with the female connector portion. The automatic sealing means includes valve core 90 threadedly mounted within passageway 70 of the male connector portion adjacent the piston. The valve core includes body 92 exteriorly sealed against the walls of the passageway by gasket 94. The valve core includes pin 96 carried in an internal passageway (not shown) of body 92. The pin has an enlarged head 98 and is biased by an internal spring (not shown) in direction 86 into contact with the end of the piston about the passageway 74. Thus, within a limited range, the piston and the pin of the valve core move as a unit.

Figure 4:
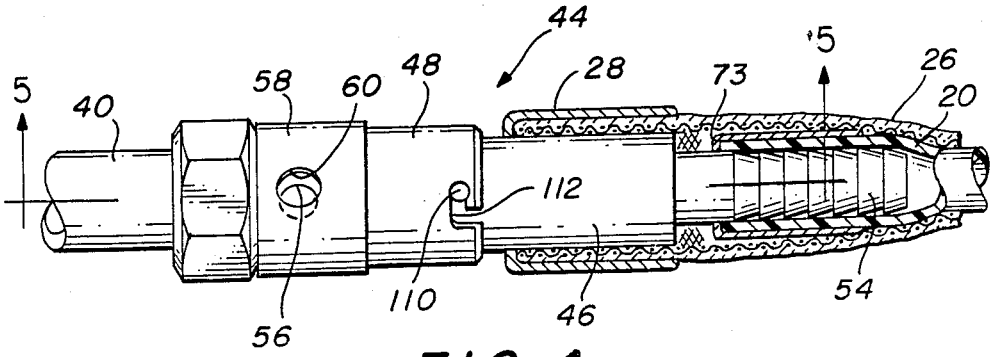
FIG. 4 is a side view, partially in cross section, of the connector of the fireplace starter apparatus of FIG. 1.
Figure 5A:
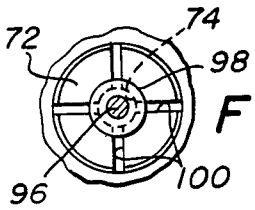
FIG. 5*a* is a cross sectional view of FIG. 5 along plane 5A—5A.

As shown in FIG. 5*a*, one or more grooves 100 are formed in the end surface of the piston to prevent the pin from sealing off the end of the passageway 74 in the piston against the flow of fuel. Alternatively, the end of passageway 70 may be formed on the end of the piston away from the area contacted by head 98 to ensure flow of fuel. The other end of the pin includes cup 102 which presents a gasket (not shown) to the end of the body so that the internal passageway of the valve core 90 is completely sealed against the flow of fuel when the cup gasket contacts the body of the valve core. An Eaton model 100-LT or 100-VB valve core may be used in the connector shown in FIGS. 4 and 5. The valve core acts to automatically seal the conduit 20 when not engaged with the burner through connector 44. This is an extremely important safety feature in that the connector may be inadvertently disengaged without first closing valve 16. In such a case, pressurized fuel would otherwise be allowed to escape from the conduit at or near the fireplace, with obvious and serious safety considerations.

The male connector portion 48 is received within the cavity 52 of the female portion 46 with the piston 72 inserted into the passageway 50. However, the spring 82 is compressed as the male and female connector portions are brought together, pushing the piston 72 and the pin 96 in direction 88. The movement of the pin unseals the internal passageway of the valve core by shifting the cup and cup gasket in direction 88, also against the force of the valve core spring, enabling unimpeded flow of the fuel through the connector.

Means are provided to releasably secure the male and female connector portions together. In the illustrated embodiment, the securing means takes the form of rod 110 mounted in the male connector portion and radially projecting therefrom. A "J" shaped slot 112 is formed in the female connector portion. As the male and female connector portions are brought together, the rod is inserted into the slot 112 and the male and female connector portions twisted with respect to each other so as to place the rod in the slot as shown in FIG. 4. The connector portions are secured by the force of compressed spring 82 urging the connector portions apart. The male and female connector portions are easily and quickly disengaged by reversing this process and extracting the male connector position from the cavity 50 of the female connector portion.

Figure 7:
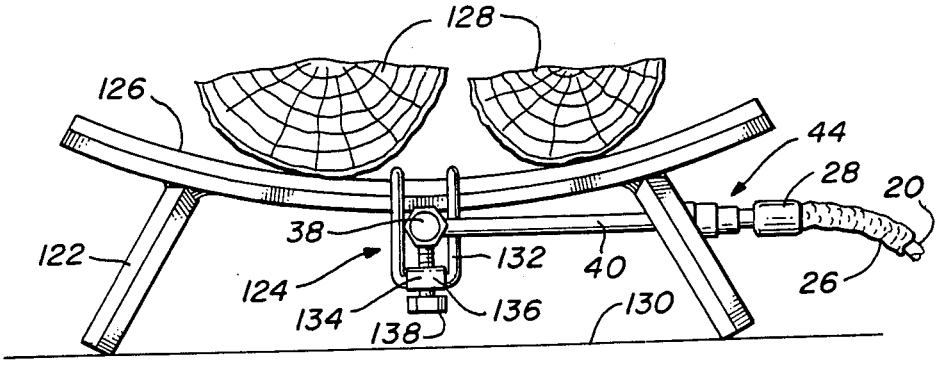
FIG. 7 is a magnified side view of the starter element of FIG. 6 attached to a grate in the fireplace.
Figure 8:
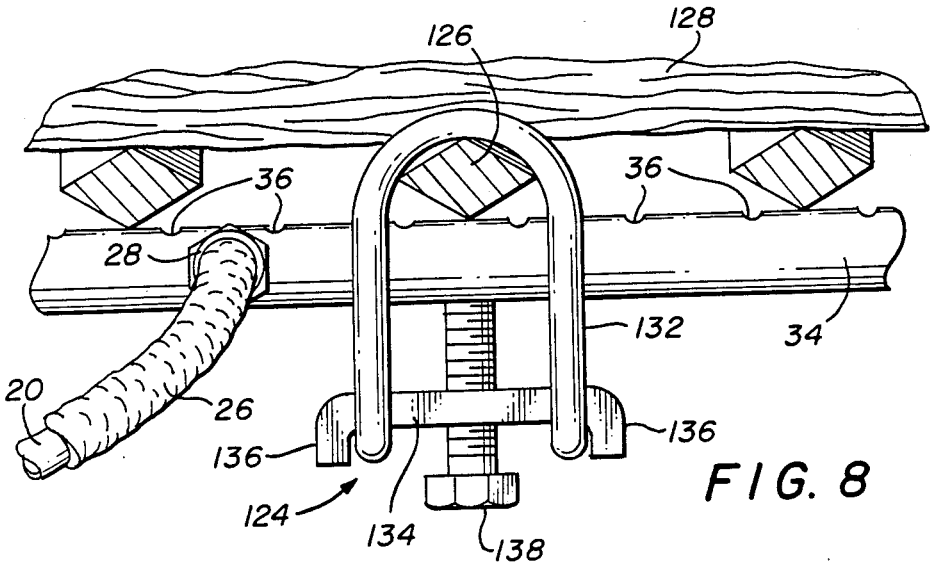
FIG. 8 is a magnified front view of the starter element of FIG. 6 attached to a grate in the fireplace.

As shown in FIG. 6, the burner is inserted into fireplace 120 and mounted on the grate 122. In the illustrated embodiment, the burner is attached to grate 122 by bracket 124. For purposes of this invention, the term "fireplace" includes any structure for burning a combustible material and specifically includes, but is not limited to, fireplaces built into a structure, freestanding fireplaces and other structures such as charcoal grills, wood burning stoves or the like. Grate 122 consists of a framework of rigid bars 126 supporting one or more pieces of wood 128 or a similar combustible material above the bottom surface 130 of the fireplace. However, for purposes of this invention, the term "grate" shall include any structure capable of supporting combustible material in a fireplace, including free standing structures and structures mounted by or in the fireplace. Bracket 124, shown in greater detail in FIGS. 7 and 8, includes a generally U-shaped clamp ring 132 suspended in a desired position on either side of a bar 126 forming a part of the grate. Clamp bar 134 extends across the spaced legs of the clamp ring and includes a pair of spaced downwardly extending flanges 136 on the outer sides of the clamp ring for loosely positioning the clamp bar with respect to the clamp ring. The clamp bar also includes a threaded aperture (not shown) engaging upwardly extending screw 138 or the like. The burner is secured to the grate by inserting the tubular section 34 transversely into the clamp ring above the clamp bar with the clamp ring suspended from the grate bar 126. In this position, the screw 138 is tightened against the tubular section 34 securing the burner against the underside of the bar 126 of the grate with the apertures 36 presented to the wood 128. Other arrangements are possible in securing the burner to the grate, including, but not limited to, permanent mounting such as by welding.

The canister 12 is placed outside, but adjacent to the entrance to the fireplace 120. The canister is placed a sufficient distance from the fireplace for safety considerations, yet close enough for convenience in operating the apparatus. If desired, as a further safety feature, the canister may be encapsulated in a thermally insulating layer or sleeve (not shown) so as to protect the canister from heat generated in the fireplace during use. The conduit 20 is connected at one end to a canister 12 placed outside of the fireplace and at the other end through the connector 44 to the burner 30. Although not shown, fireplaces are frequently equipped with a screen or like device for containing sparks and coals from leaving the fireplace. The conduit 20 is easily inserted through or around the screen to the interior of the fireplace.

When it is desired to light the wood 128 or the like in the fireplace, the valve 16 on the container 12 is opened and the fuel conveyed through the conduit 20 and the burner 30 into the fireplace and ignited by an external device (not shown) such as a match or the like. Manipulation of the slip ring 58 in conjunction with the air hole enables the air fuel mixture to be adjusted, consequently controlling the height and intensity of the ignited fuel being released from the burner. The valve on the canister is closed when the fire in the fireplace is self sustaining. During periods of inactivity for the fireplace or after a fire has been started in the fireplace, the conduit 20 may be quickly and easily disconnected from the burner 30 and stored away from the fireplace. As previously described, valve core 90 acts to automatically seal the conduit from the accidental release of fuel. Also, when the fuel in the canister has been used up, the canister may be easily and quickly replaced by disconnecting the canister from the valve and reattaching a new full canister to the valve for further operations. Under normal use of the fireplace, since the burner is normally left attached to the grate, it is not necessary to wait for the burner to cool before disengaging and storing the canister and conduit, or to frequently clean the burner of soot, ashes or other contaminates. Since the burner is raised above the ashes and coals on the bottom 130 of the fireplace, the burner is kept clean for a longer period of time and is placed in a more effective position for starting a fire with the combustible materials.

Figure 9:
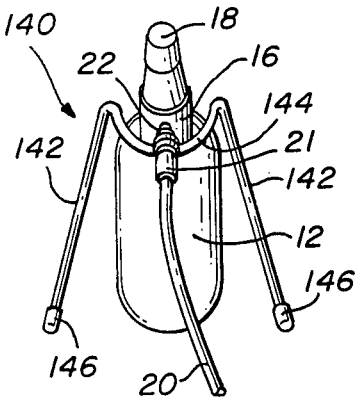
FIG. 9 is a front view of an alternate embodiment of the canister of FIG. 1.
Figure 10:
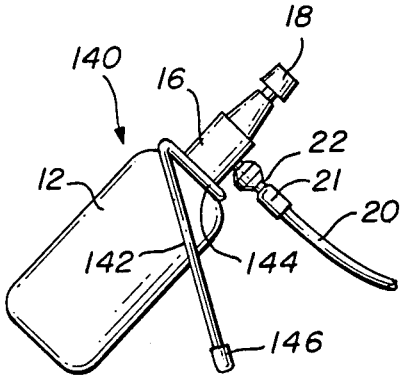
FIG. 10 is a side view of the canister of FIG. 9.

An alternate embodiment of the invention is shown in FIGS. 9 and 10 in which the stand 14 of FIG. 1 has been replaced by wire rack 140. The wire rack 140 includes a pair of inclined spaced legs 142 connected by an arcuate section 144 for supporting the canister. Preferably, the legs 142 each terminate in a foot 146 adapted for frictionally gripping a surface. The wire rack can be advantageous in that it supports the container 12 in an inclined position, enabling the fuel in the container to vaporize and flow from the container in a more efficient manner than if the canister were supported in an upright position. In all other aspects, this embodiment of the invention functions as hereinabove described.

Figure 11:
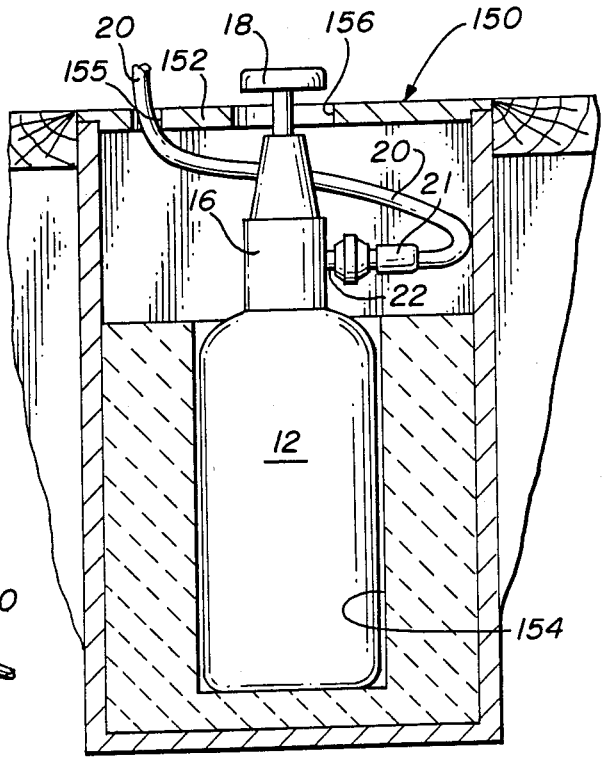
FIG. 11 is a front view of a storage compartment for the canister of FIG. 1.

Yet another alternate embodiment of the invention is shown in FIG. 11. In this embodiment, a storage compartment 150 is provided for receiving the canister 12. The storage compartment 150 includes a removable or hinged door 152 and a receptacle 154 formed in the storage compartment for securing the canister and insulating the canister from ambient extremes in temperature. The valve 16 is presented for attachment to conduit 20. Conduit 20 extends outwardly through hole 155 in the door for connection to the burner as herein described. The handle 18 of the canister expands upwardly through opening 156 in the door for external manipulation. The storage compartment is constructed in a floor or other like surface adjacent the fireplace. The chamber may also be constructed in a wall or the like adjacent the fireplace with a hinged front door. Alternatively, the handle 18 may be omitted and a key (not shown) provided for insertion through opening 156 and direct engagement with valve 16, as in conventional fireplace valves. In such an embodiment, a cap (not shown) may be provided to cover the opening 156 when the canister is not in use. Other configurations are also possible that enable access to the receptacle for loading or unloading the canister from the storage compartment (not shown). In another version of the storage compartment, the conduit 20 may be omitted and either the male or female portion of the connector mounted directly on the valve 16 on the canister. The other of the male or female connector portion is presented for direct connection to the canister within the storage compartment.

Although the invention has been disclosed above, with regard to particular and preferred embodiments, these are advanced for illustrative purposes only, and are not intended to limit the scope of this invention. For instance, it is within the scope of this invention to provide a connector that omits the air hole 56 and slip ring 58 as herein described and releases the fuel within the fireplace without prior intermixing with air. Alternative connector designs may also be employed in the present apparatus. For instance, a Snaptite, Inc. G/GF series of quick disconnect couplings; a B.P. Products No. 3162 quick connector; or the quick connector used in the Coleman model no. 5445-A5661 hose assembly have all been found suitable for use in the present apparatus. Finally, it is within the spirit and scope of this invention to include a tubular section or rigid hollow rod as part of the conduit (not shown) on the end of the conduit inserted in the fireplace, with one of the connector portions mounted on the distal end of the tubular section and preferably with a heat insulating handle on the proximate end. The rigid hollow rod would facilitate the connection of the conduit to the burner, particularly when the grate is remotely located from the front of the fireplace. These variations remain within the invention as claimed below.

What is claimed is:

1. Apparatus for setting on fire combustible solid material in a fireplace, comprising:

(a) a conduit adapted at a first end for connection to a source of flammable gas and including means for manually regulating the flow of the flammable gas through said conduit and further including a connector at a second end of said conduit;

(b) a burner adapted for attachment to said fireplace adjacent the ordinary location of the combustible solid material;

(c) a tube having one end attached to and communicating with said burner and having its other end spaced apart from said burner, with said other end including a cooperating connector adapted for releasable connection to the connector of said conduit; and (d) means for permitting the flow of flammable gas through said connector of said conduit when said connector is connected to said tube and for preventing the flow of gas through said connector when said connector is not connected to said tube.

2. The apparatus of claim 1 wherein said conduit also includes an extended, substantially rigid section adjacent the second end of said conduit and also includes a flexible section between said substantially rigid section and the first end of said conduit.

3. The apparatus of claim 1 further comprising an air hole for drawing air into the flammable gas prior to the release of said gas from said burner.

4. The apparatus of claim 1 wherein said connector of said conduit is quickly connectable to and releasable from said cooperating connector of said tube.

5. The apparatus of claim 4 wherein said connector is connectable to said cooperating connector without tools and without requiring 360° of relative angular rotation between said connector and said cooperating connector.

6. The apparatus of claim 5 wherein said connector is releasable from said cooperating connector without tools and without requiring 360° of relative angular rotation between said connector and said cooperating connector.

7. The apparatus of claim 1 further including means for attaching said burner to said fireplace.

8. The apparatus of claim 1 further including an insulating sleeve for enclosing a canister for supplying flammable gas so as to insulate the canister from heat generated in the fireplace during use.

9. An apparatus for setting on fire combustible solid material in a fireplace, comprising:

(a) a conduit adapted at a first end for connection to a source of flammable gas and including means for manually regulating the flow of the flammable gas through said conduit;

(b) a burner adapted for attachment to said fireplace adjacent the ordinary location of the combustible solid material;

(c) a tube having one end attached to and communicating with said burner and having its other end spaced apart from said burner;

(d) a connector attached to a second end of the conduit and having through a body of said connector a bore communicating with said conduit, said connector further including within said bore a piston movable between first and second positions and biased toward the first position and said connector further including means for sealing the bore when said piston is in the first position and for unsealing the bore when said piston is in the second position; and (e) a cooperating connector attached to a second end of said tube and removably engagable with the connector of the conduit without requiring 360° of relative rotation between said connector and said cooperating connector, with said cooperating connector adapted to move said piston toward its second position when said connector is engaged with said cooperating connector so as to establish fluid communication between said conduit and said tube.

10. The apparatus of claim 9 wherein said connector of said conduit further includes a seal in said bore between said piston and said connector body and said piston further includes a longitudinal passage therethrough so that when said connector is engaged with said cooperating connector and said piston is in the second position, the path of fluid communication between said conduit and said tube includes said passage.

11. The apparatus of claim 10 wherein the means for sealing and unsealing the bore includes a replaceable valve core mounted within said bore of said connector.

* * * * *

UNITED STATES PATENT AND TRADEMARK OFFICE

CERTIFICATE OF CORRECTION

PATENT NO. : 4,779,608

DATED : October 25, 1988

INVENTOR(S) : T. Randolph Smith

It is certified that error appears in the above-identified patent and that said Letters Patent is hereby corrected as shown below: Title page:

In the Abstract, first word, second line, delete "fin" and insert -- in --.

Signed and Sealed this

Seventh Day of March, 1989

*Attest:*

DONALD J. QUIGG

*Attesting Officer*

*Commissioner of Patents and Trademarks*